US006062177A

United States Patent [19]

Becker et al.

[11] Patent Number: 6,062,177

[45] Date of Patent: May 16, 2000

[54] HAND-GUIDED WORKING TOOL SUCH AS A TRIMMER, MOTOR CHAINSAW, OR CUTTER WITH AN INTERNAL COMBUSTION ENGINE WITH AN AIR INTAKE BLOWER

[75] Inventors: Georg Becker, Schwaikheim; Hans-Georg Wiedmann, Backnang; Dieter Angstenberger, Leutenbach, all of Germany

[73] Assignee: Andreas Stihl AG & Co., Waiblingen, Germany

[21] Appl. No.: 08/855,729

[22] Filed: May 9, 1997

[30] Foreign Application Priority Data

May 9, 1996 [DE] Germany ..... 196 18 669

[51] Int. Cl.[7] ..... F01P 7/00

[52] U.S. Cl. ..... 123/65 BA; 123/41.63

[58] Field of Search ..... 123/65 BA, 41.56, 123/41.63, 41.65, 41.7, 198 E

[56] References Cited

U.S. PATENT DOCUMENTS 3,994,067 11/1976 Hazzard et al. .

FOREIGN PATENT DOCUMENTS 0320576 6/1989 European Pat. Off. .

0428187 5/1991 European Pat. Off. .

0567037 10/1993 European Pat. Off. .

3708289 9/1997 Germany .

*Primary Examiner*—Noah P. Kamen

*Assistant Examiner*—Jason Benton

*Attorney, Agent, or Firm*—Robert W. Becker & Associates

[57] ABSTRACT

A hand-guided working tool has a housing and an internal combustion engine arranged in the housing. The internal combustion engine has a cylinder, a crankshaft, and a crankcase enclosing the crankshaft. An air filter box including an air filter element is connected to the internal combustion engine. A tool is driven by the crankshaft. The housing has a blower chamber with a cooling air inlet, at least one combustion air inlet, and a combustion air outlet. A combustion air channel connects the combustion air outlet to the air filter box. A blower, driven by the crank shaft and arranged in the blower chamber, is provided for taking in cooling air through the cooling air inlet and supplying the cooling air to the internal combustion engine and for taking in combustion air through the at least one combustion air inlet and guiding the combustion air through the combustion air outlet, the combustion air channel, and the air filter box to the internal combustion engine. The blower includes a first blower wheel for conveying cooling air and a second blower wheel for conveying combustion air.

18 Claims, 4 Drawing Sheets

HAND-GUIDED WORKING TOOL SUCH AS A TRIMMER, MOTOR CHAINSAW, OR CUTTER WITH AN INTERNAL COMBUSTION ENGINE WITH AN AIR INTAKE BLOWER

BACKGROUND OF THE INVENTION

The present invention relates to a hand-guided working tool, especially a trimmer, a motor chainsaw, a cutter etc., comprising an internal combustion engine with a cylinder and a crankcase enclosed in a housing, wherein a crankshaft that drives a tool and a blower is provided, the blower arranged in a blower chamber and taking in cooling air through a cooling air inlet to be supplied to the internal combustion engine, wherein the blower has furthermore at least one combustion air inlet for taking in combustion air that is guided via a combustion air outlet through a combustion air channel to an air filter box.

From German Patent 37 08 289 a motor chainsaw is known having a housing with an air-cooled combustion engine. On one end of the crankshaft of the combustion engine a drive member (chain-driving pinion) for a tool is provided, i.e., a saw chain guided within a guide rail. The other end of the crankshaft supports a blower wheel that is embodied as a fly wheel for providing the required cooling air flow to the cylinder of the internal combustion engine. The blower wheel conveys at the same time combustion air to the air filter box of the internal combustion engine whereby air guiding vanes are provided which separate the combustion air intake from the cooling air intake for providing a separate intake path of cooling air and combustion air. With this arrangement, combustion air is to be supplied to the engine from a less contaminated area. The required expenditure, however, is very high and cannot ensure that a sufficient separation of the combustion air flow from the cooling air flow is provided. The air guiding vanes increase the axial constructive length substantially and impede furthermore the formation of the cooling air flow.

It is therefore an object of the present invention to improve a working tool of the aforementioned kind such that for a minimal constructive space and with simple constructive means a sufficient cooling air flow and a clean combustion air flow are provided.

SUMMARY OF THE INVENTION

A hand-guided working tool according to the present invention is primarily characterized by:

A housing;

An internal combustion engine arranged in the housing;

The internal combustion engine comprising a cylinder, a crankshaft, and a crankcase enclosing the crankshaft;

An air filter box including an air filter element connected to the internal combustion engine;

A tool driven by the crankshaft;

The housing having a blower chamber;

The blower chamber having a cooling air inlet, at least one combustion air inlet, and a combustion air outlet;

A combustion air channel connects the combustion air outlet to the air filter box;

A blower, driven by the crankshaft and arranged in a blower chamber, for taking in cooling air through the cooling air inlet and supplying the cooling air to the internal combustion engine and for taking in combustion air through the at least one combustion air inlet and supplying the combustion air through the combustion air outlet, the combustion air channel, and the air filter box to the internal combustion engine;

The blower comprised of a first blower wheel for conveying cooling air and a second blower wheel for conveying combustion air.

Advantageously, the second blower wheel is positioned within the blower chamber between the first blower wheel and the internal combustion engine.

Advantageously, the cooling air inlet is positioned opposite an end face of the first blower wheel facing away from the internal combustion engine and the at least one combustion air inlet is positioned facing an end face of the second blower wheel facing the internal combustion engine.

Preferably, the at least one combustion air inlet is positioned in an area of the crankcase facing away from the cylinder.

Preferably, the at least one combustion air inlet is positioned in a wall of the blower chamber, the wall connected to the crankcase.

The first and second blower wheels are fixedly and non-rotatably connected to one another and are connected to a first end of the crankshaft.

The blower has a common base body for the first and second blower wheels. The common base body has a first axial end face with annularly arranged cooling vanes forming a cooling vane ring and defining the first blower wheel. The common base body has a second axial end face with annularly arranged conveying vanes forming a conveying vane ring and defining the second blower wheel.

The cooling vanes have greater axial length than the conveying vanes.

The common base body includes a partition between the first and second blower wheels, wherein the blower has magnets connected to a circumferential surface thereof, and wherein the magnets are arranged within the conveying vane ring and extend across the partition into the cooling vane ring.

Preferably, the blower chamber has an air guiding spiral opening in a direction toward the internal combustion engine wherein the first and the second blower wheels are arranged in the air guiding spiral.

The air guiding spiral has a widened channel section in which the combustion air outlet is arranged. The combustion air outlet is positioned at a level defined by a plane extending parallel to a bottom of the housing through a center axis of the blower.

In a preferred embodiment of the present invention, the end face of the second blower wheel facing the internal combustion engine is positioned at a distance to the wall of the combustion chamber, and in the axial direction of the crankshaft a cross-section of the combustion air outlet and the second blower wheel overlap one another.

The air filter box has preferably a connecting socket. The combustion air channel consists of an elastomeric plastic material and is detachably connected to the combustion air outlet and the connecting socket.

The combustion air channel is snapped into the combustion air outlet and is slipped onto the connecting socket.

The combustion air channel is L-shaped and a leg of the L-shaped combustion air channel that is connected to the combustion air outlet extends parallel to the axis of rotation of the crankshaft.

The filter element is preferably a sheet filter element comprising a sealing edge for dividing the interior of the air filter box into a clean chamber and a dirt chamber.

The sealing edge preferably consists of sponge rubber.

The air filter box has a connecting socket that opens into the interior of the air filter box at a lower end of the uprightly arranged sheet filter element.

The first blower wheel takes in cooling air through the cooling air inlet while the second blower wheel conveys combustion air, along a path that is completely separate from the cooling air flow, via the combustion air inlet. This allows the possibility to adjust the first blower wheel for the cooling air and the second blower wheel for the combustion air to be adjusted to the required respective supply volume of the cooling air flow and the combustion air flow whereby the two air flows can be formed without affecting one another. The combustion air inlet can be provided at a freely selectable location of the housing where contamination is minimal. Advantageously, the cooling air inlet is arranged opposite the end face of the cooling air blower wheel which end faces faces away from the end face of the combustion air blower wheel positioned opposite the combustion air inlet openings.

Expediently, the combustion air blower wheel is arranged between the internal combustion engine and the cooling air blower wheel. Thus, the combustion air can be taken in at a location neighboring the hot air area of the combustion engine, while the cooling air can be taken in from a cold air area remote from the combustion engine. The combustion air blower wheel is preferably arranged within the common blower chamber into which the combustion air is introduced and in which it is accelerated.

When the combustion air inlet is arranged within the crankcase area which faces away from the cylinder of the internal combustion engine, the takein of the combustion air from this hot air area results in an air exchange. The following cooler air thus cools the crankcase as well as the neighboring fuel tank.

According to a preferred embodiment, the combustion air blower wheel and the cooling air blower wheel have a common base body the axial end faces of which support cooling air vanes and combustion air vanes arranged in a respective cooling vane ring and a respective combustion air vane ring. The thus formed unitary component is advantageously a cast part and can simultaneously serve as the flywheel for the combustion engine. The vane rings at both sides of the blower are separated by a partition so that the cooling air conveying area of the blower and the combustion air conveying area of the blower are separated from one another. Preferably, the vane ring of the cooling air blower wheel is, for example, multiple times wider in the axial direction than the vane ring of the combustion air blower wheel. The cooling air blower wheel thus has an increased throughput as compared to the combustion air blower wheel in compliance with the greater need of cooling air of the combustion engine in comparison to combustion air. The flywheel can support at its circumferential surface magnets so that the flywheel can simultaneously act as the magnet wheel of a magnetic ignition. These magnets are preferably positioned within the vane ring of the combustion air blower wheel and extend to a small extent from the vane ring of the combustion air blower wheel across the common partition axially into the vane ring of the cooling air blower wheel. With this embodiment of the base body having a partition between the blower wheels, an increased stability of the flywheel is achieved so that the flywheel is strong enough to withstand the dynamic loading during operation even though it is of a minimal constructive volume and weight. Furthermore, it conveys an increased total volume flow, comprised of the cooling air flow, and the combustion air flow in comparison to single vane ring flywheels of otherwise identical dimensions.

The blower chamber is embodied as an air guiding spiral open to the combustion engine whereby the air is accelerated by the vane rings and is guided along the widening air guiding spiral. Dirt particles contained within the air are thus accelerated in the direction of the circumferential wall of the blower chamber so that a prefiltering action of the air flow is provided. The cooling air exits from a channel section of the air guiding spiral in a directed manner onto the combustion engine and the cooling ribs arranged at the cylinder.

The transport of the combustion air away from the air guiding spiral is achieved with a combustion air outlet to which is connected a combustion air channel of a preferably substantially rectangular cross-section. The combustion air outlet is preferably arranged at the end face of the blower chamber connected to the crankcase at the level of a diameter of the blower wheel extending parallel to the bottom of the working tool housing within in a widened channel section of the air guiding spiral. It is positioned at a radial distance from the circumferential wall. Viewed in the axial direction of the crankshaft, the combustion air blower wheel partly overlaps the combustion air outlet so that the combustion air is subjected to a right angle deflection from the conveying direction of the blower wheel for further transport through the combustion air outlet. This prevents substantially that dirt particles can follow the flow path. The combustion air channel is comprised of an elastomeric plastic material and is detachably connected to the combustion air outlet as well as to the connecting socket of the air filter box. The especially L-shaped combustion air channel that is advantageously rectangular in cross-section is snapped into the combustion air outlet with one end and with the other end is connected by slipping it onto the connecting socket. The connecting socket has a design corresponding to the design of the combustion air channel so that an air-tight connection is provided.

The air filter box has advantageously arranged therein a sheet filter element that divides the interior of the box into a dirt chamber and a clean chamber. The sheet filter element comprises a sealing edge which is preferably made of sponge rubber. The connecting socket opens advantageously into the lower area of the sheet filter element positioned substantially perpendicularly within the air filter box relative to the inflow opening. The inflow direction of the sheet filter element is thus counter to the gravitational force so that the contamination filtered out from the combustion air by the sheet filter element can fall down counter to the flow direction and can be collected at the bottom of the dirt chamber.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 4.

Figure 1:
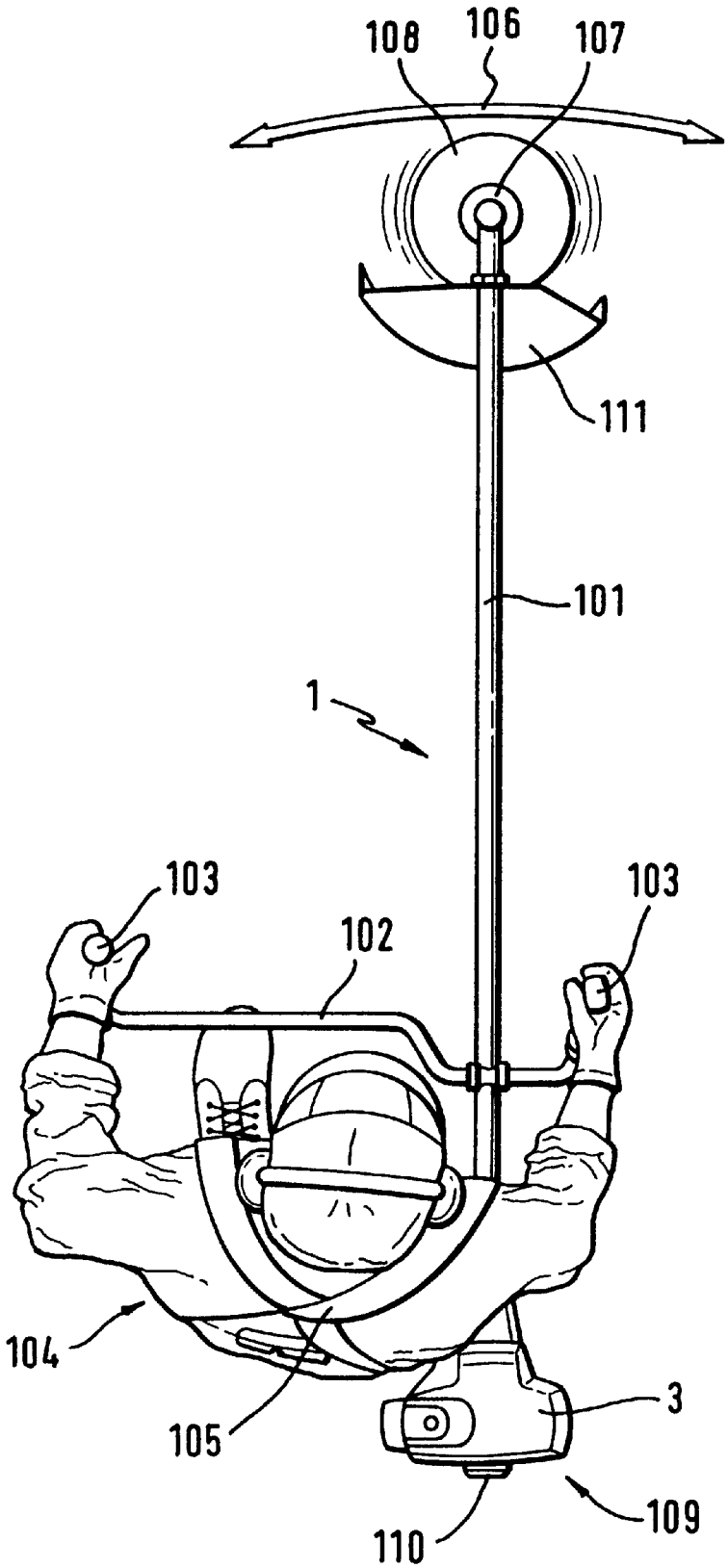
FIG. 1 is a plan view of a hand-guided trimmer.

The hand-guided working tool represented in FIG. 1 is a trimmer for mowing grass, cutting underbrush etc. It is comprised substantially of a guide rod 101 to which is connected a handle bar 102. The handle bar 102 has two grips 103 at its ends which serve for guiding and operating the trimmer 1 by the operator 104 who carries the trimmer with a strap arrangement 105.

Figure 2:
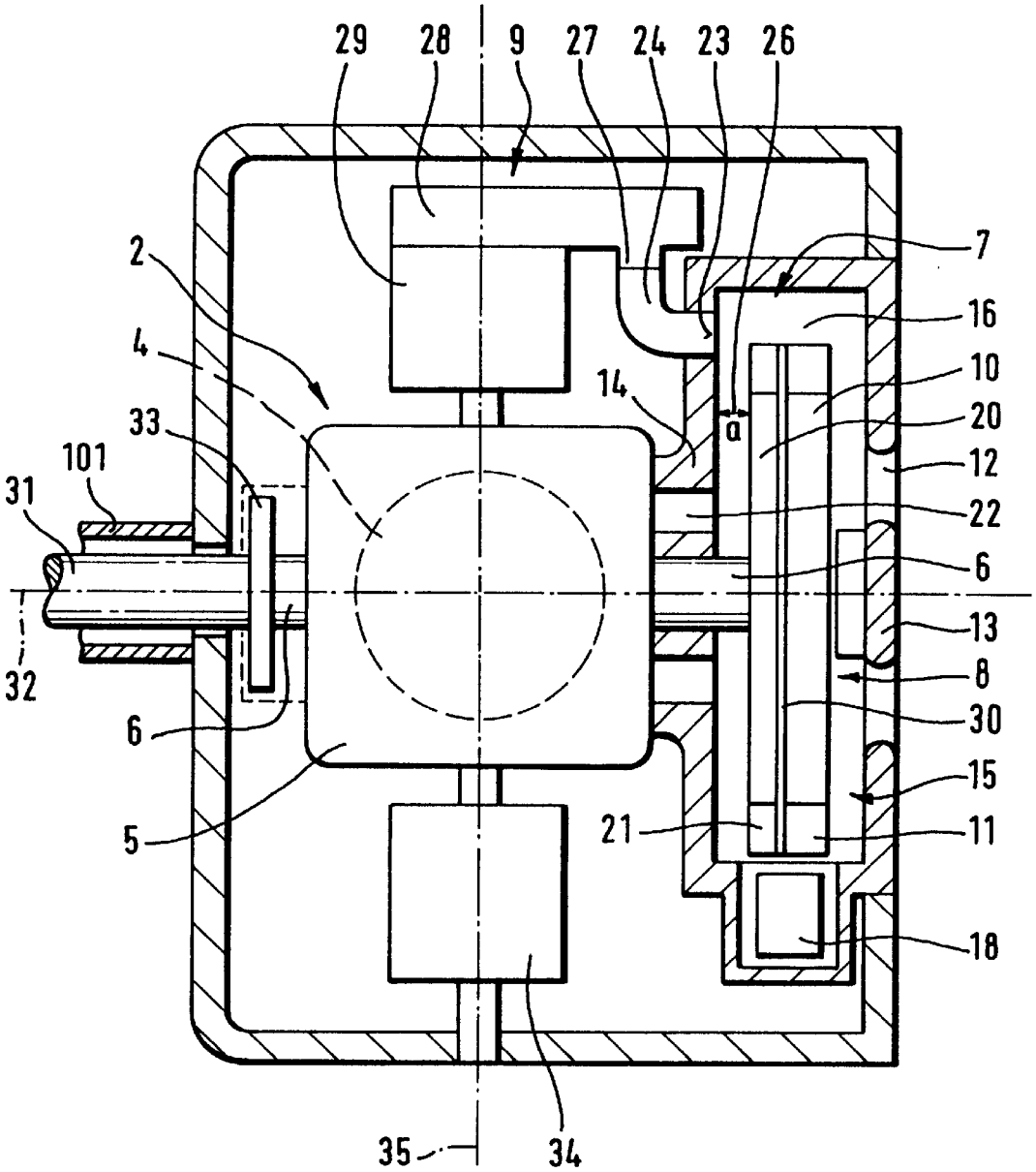
FIG. 2 is a schematic representation of a section of the housing of the trimmer according to FIG. 1.

At one end of the guide rod 101 a drive unit 109 is fastened which is substantially comprised of an internal combustion engine 2 (FIG. 2) arranged in a housing 3 which in the shown embodiment is an air-cooled two-stroke engine which is supplied with combustion air and cooling air by a blower unit 110. The engine drives an output shaft 31 which is connectable with a centrifugal clutch 33 to the crankshaft 6 of the combustion engine 2 (FIG. 2). The flexible output shaft 31 is supported in the guide rod 101 which is embodied as a tube and drives via a bevel gear arrangement 107 a tool 108, in the shown embodiment a knife blade, in a rotating fashion. The trimmer is moved similar to the reciprocating movement of a scythe in the direction of arrow 106.

In the schematic representation of FIG. 2, the basic arrangement of the parts within the housing 3 is shown. The internal combustion engine 2, comprised of a cylinder 4 and a crankcase 5, drives with one end of the crankshaft 6 the output shaft 31 via the clutch 33. At the other end of the crankshaft 6 a blower chamber 7 is provided in which a blower 8 with two vane rings is arranged. The blower 8 has axial sections embodied such that a cooling air-supplying cooling air blower wheel 10 and a combustion air-supplying combustion air blower wheel 20 are provided spaced from one another in the axial direction. The combustion air blower wheel 20 (second blower wheel) is arranged on the side of the cooling air blower wheel 10 facing the combustion engine 2.

The first blower wheel 10 for the cooling air takes in cooling air at an end face facing away from the combustion engine which cooling air is taken in via a cooling air inlet 12 at the blower cover 13 into the blower chamber 7. Simultaneously to the intake of cooling air, combustion air is taken in by the synchronously revolving second blower wheel 20 which thus provides a separate combustion air flow by sucking in air through the combustion air inlet 22 provided in a blower chamber wall 14 adjacent to the crankcase. The combustion air taken in in the area of the crankcase is thus already preheated and free of dirt particles because it is supplied from the interior of the housing 3 axially into the blower chamber 7.

The second blower wheel 20 comprises a vane ring 21 facing the blower chamber wall 14 and the first blower wheel 10 is provided with a vane ring 11. The vane rings 11 and 21 are separated from one another by a radial separating wall (partition) 30 of the blower 8. It is thus ensured that the partial air streams within the blower chamber 7 are completely independent from one another and can be formed without affecting one another.

The blower chamber 7 is embodied with an air guiding spiral 15 open toward the combustion engine 2 so that the air flows generated by the first and second blower wheels 10, 20 of the blower 8 are accelerated by the channel delimited by the air guiding spiral in the direction toward the circumferential wall. Dirt particles contained within the air flows are thus separated by centrifugal force. In the widened channel section 16 of the air guiding spiral 15 the combustion air is axially supplied into the combustion air outlet 23 which is arranged within the blower chamber wall 14 at a distance to the circumferential wall of the blower chamber 7. The second blower wheel 20 extends in the radial direction to such an extent that it partly overlaps the combustion air outlet 23 by an axial distance a. This distance a between the blower wall 14 and the vane ring 21 of the second blower wheel 20 is determined by the axial position of the blower. Due to this construction the combustion air is accelerated within an area of the air guiding spiral 15 that is adjacent to the blower chamber wall 14.

The combustion air sucked in via the combustion air outlet 23 into the combustion engine 2 is guided through a combustion air channel 24 into the air filter box 9 where it is cleaned by the sheet filter element 28 and then introduced into the fuel metering device 29. After completion of the combustion process within the cylinder 4 of the internal combustion engine 2, the exhaust gas is introduced into the muffler 34 and is exhausted. A partial stream of the combustion air which is not supplied to the combustion air outlet 23 exits through a widened portion of the channel section of the air guide spiral 15 together with the cooling air flow and flows along the combustion engine 2. An ignition device 18 is positioned diametrically opposite this channel section in a narrow channel section of the air guiding spiral 15 for providing external ignition of the compressed fuel mixture within the cylinder 4 of the internal combustion engine 2.

Figure 3:
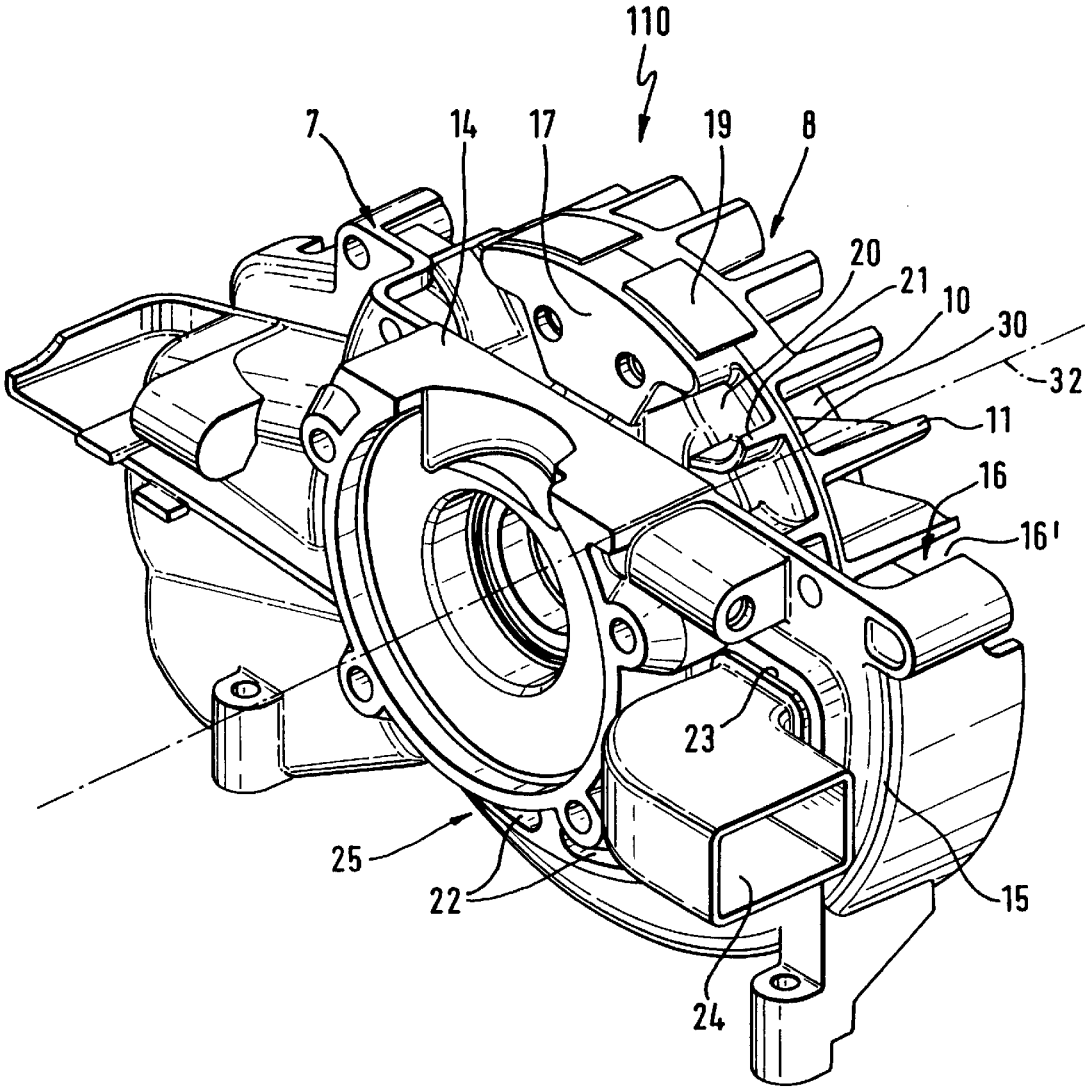
FIG. 3 is a perspective view of the blower with blower chamber and blower wheels.

FIG. 3 shows in a perspective view the blower unit 110 whereby the location of the onlooker is approximately at the point of interception of the transverse cylinder axis 35 and of the air filter box wall of the housing 3 (FIG. 2) approximately at the level of the cylinder 4. The wall 14 of the blower chamber 7 is a unitary part of the wall of the crankcase shown in FIG. 3. In the blower chamber 7 the blower 8 is arranged which is a one-part cast metal part which is comprised of a blower wheel 10 for conveying the cooling air and a blower wheel 20 for conveying the combustion air.

The blower wheel 20, positioned between the blower wheel 10 and the chamber wall 14, is provided at its end face with a vane ring 21 and the oppositely arranged blower wheel 10 is provided at its end face with a vane ring 11. Between the vane rings 11 and 21 a radial partition 30 is provided which separates the cooling air area of the blower wheel 10 and the combustion air area of the blower wheel 20. The vane ring 11 of the blower wheel 10 has a greater axial width than the vane ring 21 of the blower wheel 20. Thus, the blower wheel 10, has a greater air flow throughput proportional to the width ratio of the vane rings 11 and 21 according to the higher demand for cooling air of the combustion engine in comparison to the combustion air volume. The blower 8 comprised of the blower wheel 10 and the blower wheel 20 simultaneously serves as the flywheel of the combustion engine.

For this purpose, a flywheel mass 17 is provided in the form of a ring segment which is provided with axial lateral surfaces that taper to the center of the wheel and extend approximately to the radial inner end of the vane ring 21. Its circumferential edge corresponds to the outer diameter of the partition 30. Diametrically opposite a further flywheel mass is arranged (not shown). The inwardly facing end faces of the flywheel masses, in the area of the second blower wheel 20, are diametrically connected reinforcing ribs. With these reinforcing ribs and especially with the embodiment of the base body between the blower wheels 10 and 20 including the partition 30, a great stability of the flywheel is produced.

The blower 8 has a further function as a magnet wheel of the magnetic ignition whereby the magnetic wheel for activating the ignition 18 (FIG. 2) is provided at its circumference with two ignition magnets 19 which are substantially arranged within the vane ring 21 of the second blower wheel 20 and which extend axially across the common partition 30 into the vane ring 11 of the first blower wheel 10. The magnets 19 are embedded in the circumferential surface of the fly wheel 17 and in an outer portion of the vane ring 11.

The end faces of the first blower wheel 10 and the second blower wheel 20 take in completely separate air flows into the blower chamber 7. The cooling air enters via cooling air inlets 12 (FIG. 2), while the combustion air is taken in via two combustion air inlets 22 within the blower chamber wall 14 which are separated from one another by a stay. The combustion air inlet openings 22 are arranged in a crankcase area 25 facing away from the cylinder of the internal combustion engine. By taking in the combustion air from this crankcase area 25 it is ensured that the combustion engine is supplied with clean and preheated air. Due to the centrifugal effect, the dirt particles contained within the air are accelerated toward the circumferential wall of the blower chamber 7 so that due to the further transport of the combustion air flow at a right angle to the conveying direction through the combustion air outlet an air filtering action is provided.

Figure 4:
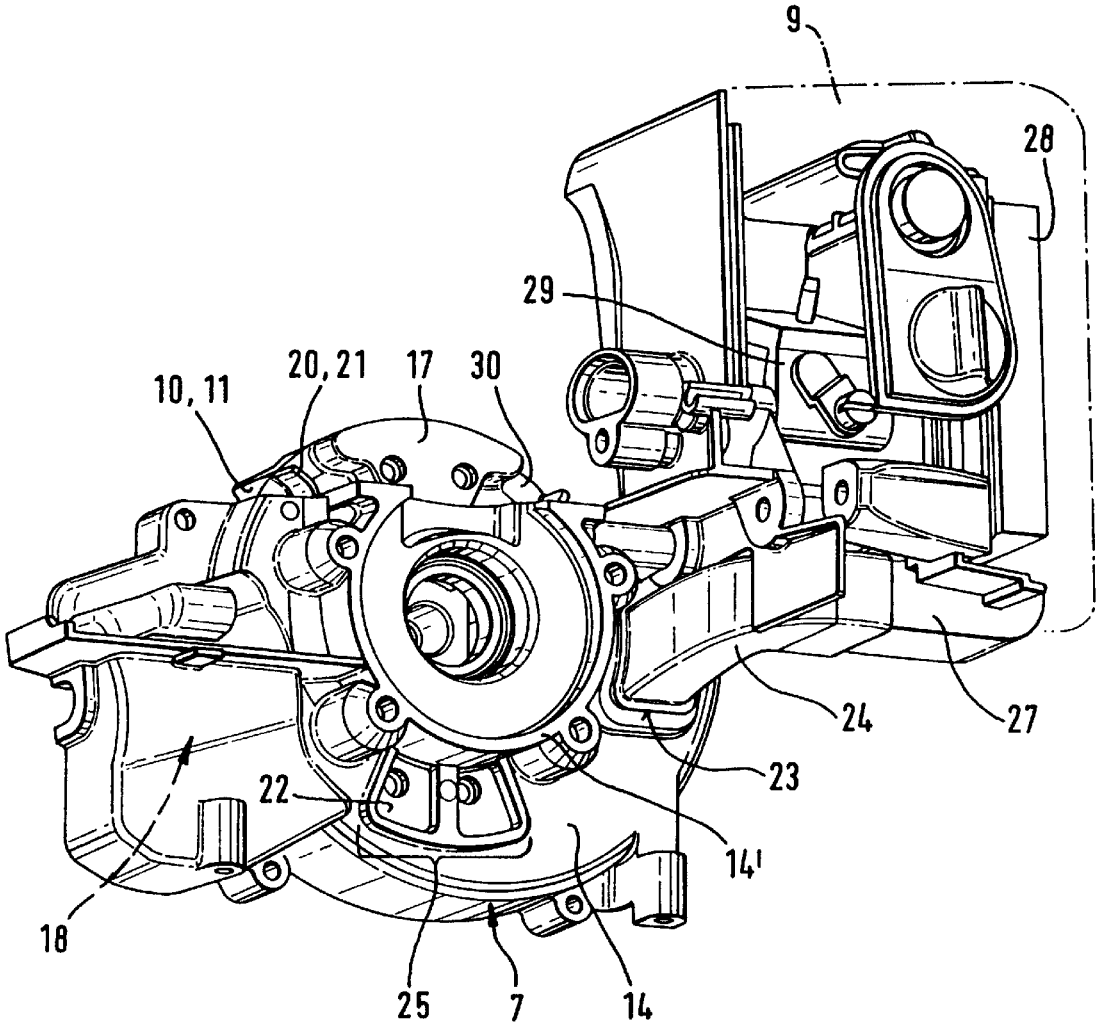
FIG. 4 is a further perspective representation according to FIG. 3 with an air filter box connected to the combustion air channel.

The second blower wheel 20 overlaps in the axial direction the combustion air outlet 23 at least partly so that the combustion air, when flowing through the combustion air outlet, must flow about the edge of the combustion air blower wheel which primarily prevents that dirt particles can follow the flow direction. A combustion air channel 24 is positive-lockingly snapped into the combustion air outlet 23 and is comprised of an elastomeric plastic material. The combustion air channel 24 has a rectangular cross-section and extends substantially L-shaped so that the combustion air flow axially exiting from the widened channel section 16 of the air guiding spiral 15 is deflected in the radial direction into the non-represented air filter box (FIG. 4). The air guiding spiral 15 downstream of the combustion air outlet 23 has an opening shaped as a circular portion cut by a chord so that a portion of the blower 8 comprising an angular distance of approximately 130° projects from the blower chamber 7. The cooling air flow is directed, together with a partial stream of the combustion air not exiting through the combustion air outlet 23, through an open channel section 16' from the air guiding spiral 15 onto the combustion engine 2 (FIG. 2).

FIG. 4 shows a further perspective view of the blower unit 110 in FIG. 3 with connected air filter box 9 in a different perspective. The blower chamber wall 14 comprises a cylindrical projection 14' coaxially extending to the crankshaft and fastened with an end face forming a flange to the crankcase 5 (FIG. 2). Thus, a crankcase area 25 is delimited by the blower chamber wall 14 from where the blower wheel 20 with its vane ring 21 axially takes the combustion air via the combustion air inlets 22 separated by a vertical stay and arranged at the bottom of the projection 14' at the chamber wall 14.

The blower chamber 7 is embodied as an air guiding spiral open toward the combustion engine whereby the cooling air as well as the amount of air not supplied as combustion air exit from the blower chamber 7 and are directed from the channel section 16 (FIG. 3) onto the internal combustion engine. Opposite this cooling air outlet an ignition device 18 is provided within a narrow channel section of the air guiding spiral for actuating the external ignition of the fuel mixture within the combustion engine.

The combustion air is accelerated by the blower wheel 20 within the air guiding spiral and is axially taken through the combustion air outlet 23 into the combustion air channel 24 which has the rectangular cross-sectional shape, already described in connection with FIG. 3. The elastic combustion air channel 24 is form-lockingly snapped into the outlet 23 and extends L-shaped from the blower chamber 7 to the inlet of the air filter box 9.

The second leg of the combustion air channel 24 is slipped onto the connecting socket 27 of the air filter box 9. Above the connecting socket 27 and above the air inlet into the air filter box 9, a sheet filter element 28 is arranged which extends at a right angle to the inflow direction of the air and divides the air filter box 9, respectively, its interior into a dirt chamber and a clean chamber. The combustion air is distributed within the dirt chamber across the surface of the sheet filter element 28 whereby the dirt particles within the air follow the gravitational force in the downward direction and are collected on the bottom of the air filter box 9. In the clean chamber of the air filter box 9, the combustion air is guided to the carburetor 29 for forming the ignitable fuel/air mixture.

The present invention is, of course, in no way restricted to the specific disclosure of the specification and drawings, but also encompasses any modifications within the scope of the appended claims.

What we claim is:

1. A hand-guided working tool comprising:

a housing;

an internal combustion engine arranged in said housing;

said internal combustion engine comprising a cylinder, a crankshaft, and a crankcase enclosing said crankshaft;

an air filter box including an air filter element connected to said internal combustion engine;

a tool driven by said crankshaft;

said housing having a blower chamber;

said blower chamber having a cooling air inlet, at least one separate combustion air inlet, and a combustion air outlet;

a combustion air channel connecting said combustion air outlet to said air filter box;

a blower, driven by said crankshaft and arranged in a blower chamber, for taking in cooling air through said cooling air inlet and supplying the cooling air to said internal combustion engine and for taking in combustion air through said at least one combustion air inlet and supplying the combustion air through said combustion air outlet, said combustion air channel, and said air filter box to said internal combustion engine;

said blower comprised of a first blower wheel for conveying cooling air and a second blower wheel for conveying combustion air radially outwardly relative to said blower wheel; and wherein said at least one separate combustion air inlet is positioned opposite an end face of said second blower wheel facing said internal combustion engine.

2. A working tool according to claim 1, wherein said second blower wheel is positioned within said blower chamber between said first blower wheel and said internal combustion engine.

3. A working tool according to claim 1, wherein said cooling air inlet is positioned opposite an end face of said first blower wheel facing away from said internal combustion engine.

4. A working tool according to claim 1, wherein said at least one combustion air inlet is positioned in an area of said crankcase facing away from said cylinder.

5. A working tool according to claim 1, wherein said at least one combustion air inlet is positioned in a wall of said blower chamber, said wall connected to said crankcase.

6. A working tool according to claim 1, wherein said first and second blower wheels are fixedly and non-rotatably connected to one another and are connected to a first end of said crankshaft.

7. A working tool according to claim 1, wherein:

said blower has a common base body for said first and second blower wheels;

said common base body has a first axial end face with annularly arranged cooling vanes forming a cooling vane ring and defining said first blower wheel; and said common base body has a second axial end face with annularly arranged conveying vanes forming a conveying vane ring and defining said second blower wheel.

8. A working tool according to claim 7, wherein said cooling vanes have a greater axial length than said conveying vanes.

9. A working tool according to claim 7, wherein said common base body includes a partition between said first and second blower wheels, wherein said blower has magnets connected to a circumferential surface thereof, and wherein said magnets are arranged within said conveying vane ring and extend across said partition into said cooling vane ring.

10. A working tool according to claim 1, wherein said blower chamber has an air guiding spiral opening in a direction toward said internal combustion engine and wherein said first and said second blower wheels are arranged in said air guiding spiral.

11. A working tool according to claim 10, wherein:

said air guiding spiral has a widened channel section in which said combustion air outlet is arranged; and wherein said combustion air outlet is positioned at a level defined by a plane extending parallel to a bottom of said housing through a center axis of said blower.

12. A working tool according to claim 1, wherein an end face of said second blower wheel facing said internal combustion engine is positioned at a distance to a wall of said combustion chamber and wherein in an axial direction of said crankshaft a cross-section of said combustion air outlet and said second blower wheel overlap one another.

13. A working tool according to claim 1, wherein said air filter box has a connecting socket, said combustion air channel consists of an elastomeric plastic material and is detachably connected to said combustion air outlet and to said connecting socket.

14. A working tool according to claim 13, wherein said combustion air channel is snapped into said combustion air outlet and is slipped onto said connecting socket.

15. A working tool according to claim 13, wherein said combustion air channel is L-shaped and wherein a leg of said L-shaped combustion air channel connected to said combustion air outlet extends parallel to an axis of rotation of said crankshaft.

16. A working tool according to claim 1, wherein said filter is a sheet filter element comprising a sealing edge for dividing an interior of said air filter box into a clean chamber and a dirt chamber.

17. A working tool according to claim 16, wherein said sealing edge consists of sponge rubber.

18. A working tool according to claim 16, wherein said air filter box has a connecting socket that opens into the interior of said air filter box at a lower end of said uprightly arranged sheet filter element.

* * * * *

UNITED STATES PATENT AND TRADEMARK OFFICE

CERTIFICATE OF CORRECTION

PATENT NO : 6,062,177

DATED : May 16, 2000

INVENTOR(S): Georg Becker, Hans-Georg Wiedmann, Dieter Angstenberger, and Ernst Buck It is certified that error appears in the above-identified patent and that said Letters Patent are hereby corrected as shown below:

On title page, item(s) should read as follows:

[54] Title:

HAND-GUIDED WORKING TOOL SUCH AS A TRIMMER, MOTOR CHAINSAW OR CUTTER, WITH AN INTERNAL COMBUSTION ENGINE WITH AN AIR INTAKE BLOWER

[75] Inventors:

Georg Becker, Hans-Georg Wiedmann, Dieter Angstenberger, and Ernst Buck

Signed and Sealed this

Seventeenth Day of April, 2001

*Attest:*

Nicholas P. Godici

NICHOLAS P. GODICI

*Attesting Officer*

*Acting Director of the United States Patent and Trademark Office*